US005605366A

United States Patent [19]

Beeman

[11] Patent Number: 5,605,366

[45] Date of Patent: Feb. 25, 1997

[54] EXTERNAL PULLING TOOL AND METHOD OF OPERATION

[75] Inventor: Robert S. Beeman, Bossier City, La.

[73] Assignee: Weatherford/Lamb, Inc., Houston, Tex.

[21] Appl. No.: 426,867

[22] Filed: Apr. 24, 1995

Related U.S. Application Data

[63] Continuation-in-part of Ser. No. 346,258, Nov. 23, 1994.

[51] Int. Cl.[6] ..... E21B 31/18

[52] U.S. Cl. ..... 294/86.28; 294/86.3; 294/86.32; 294/86.15

[58] Field of Search ..... 294/86.1, 86.12, 294/86.14, 86.15, 86.17, 86.19, 86.24, 86.25, 86.26, 86.28, 86.3, 86.32, 86.34; 166/85, 98, 215, 217, 301

[56] References Cited

U.S. PATENT DOCUMENTS

| | | |
|---|---|---|
| 803,450 | 10/1905 | Stegner . |
| 808,378 | 12/1905 | Johnston . |
| 902,468 | 10/1908 | Beckwith . |
| 1,392,650 | 10/1921 | McMillian . |
| 1,457,139 | 5/1923 | Bell et al. . |
| 1,580,352 | 4/1926 | Ventresca . |
| 1,583,767 | 5/1926 | Akins et al. . |
| 1,619,254 | 3/1927 | Hart . |
| 1,621,947 | 3/1927 | Moore . |
| 1,638,494 | 8/1927 | Lewis et al. . |
| 1,712,898 | 5/1929 | Newkirk . |
| 1,719,584 | 7/1929 | Bonner . |

(List continued on next page.)

FOREIGN PATENT DOCUMENTS

| | | |
|---|---|---|
| 0213798 | 3/1987 | European Pat. Off. . |
| 0391541 | 10/1990 | European Pat. Off. . |
| 1305245 | 1/1963 | France . |
| 381171 | 9/1923 | Germany . |
| 470725 | 1/1929 | Germany . |

OTHER PUBLICATIONS

M. A. Mullin et al., "Fishing with 1.5– and 1.75–in. Coiled Tubing at Western Prudhoe Bay, Alaska", Society of Petroleum Engineers Inc., pp. 641–646, SPE Paper 20679 for the 65th annual Technical Conference and Exhibition of the Society of Petroleum Engineers held in New Orleans, LA, Sep. 23–26, 1990.

S. H. Fowler, Jr., et al., "Operation and Utilization of Hydraulic–Actuated Service Tools for Reeled Tubing", Society of Petroleum Engineers Inc., pp. 631–640, SPE Paper 20678 for the 65th Annual Technical Conference and Exhibition of the Society of Petroleum Engineers held in New Orleans, LA, Sep. 23–26, 1990.

Selected pages from Petro–Tech Tools, Inc. parts catalogue, (No Date).

*Primary Examiner*—Dean Kramer

*Attorney, Agent, or Firm*—Baker & Botts L.L.P.

[57] ABSTRACT

An external pulling tool for retrieving a fish from a wellbore comprises a mandrel fixedly secured to an upper sub, an outer cover fixedly secured to and depending from the upper sub, a collet assembly telescopically surrounding the bottom portion of the mandrel and a support sleeve telescopically surrounding the collet assembly and positioned between the collet assembly and the outer cover. An expandable fluid cavity is formed between a portion of the facing surfaces of the support sleeve and the mandrel. A coil spring, which is disposed between the support sleeve and the upper sub, downwardly biases the support sleeve so that it rests against a lower shoulder on the outer cover when fluid pressure is not applied to the expandable cavil. The collet assembly includes a plurality of collet fingers, each having a collet head at the end thereof. The collet fingers are naturally outwardly radially biased in the direction of the outer cover. When the support sleeve rests on the lower shoulder, the collet heads are radially inwardly displaced or wedged. Before lowering or raising the outer cover to surround the fish, the support sleeve is raised by introducing fluid pressure into the expandable catty, which causes the collet heads to assume their inactive position. When lowering the external pulling tool onto the fish in this manner, collet fingers, which have low bucking resistance, do not collide with nor are axially displaced by the fish.

12 Claims, 13 Drawing Sheets

U.S. PATENT DOCUMENTS 1,728,136 9/1929 Power .
1,758,364 5/1930 Jensen .
1,779,123 10/1930 Gates .
1,794,652 3/1931 Stone .
1,795,322 3/1931 Triplett .
1,805,815 5/1931 Fitzpatrick .
1,815,462 7/1931 Denney .
1,823,340 9/1931 Vance .
1,917,135 7/1933 Littell .
1,964,913 7/1934 Halliburton .
2,016,683 10/1935 Moore .
2,074,912 3/1937 Hutto .
2,141,987 12/1938 Jones .
2,145,170 1/1939 Frenzel .
2,190,442 2/1940 Costello .
2,264,480 12/1941 Owen .
2,290,409 7/1942 Cuthill .
2,373,081 4/1945 Salverda .
2,481,637 9/1949 Yancey .
2,507,127 5/1950 True .
2,603,292 7/1952 Page .
2,621,960 12/1952 Justice et al. .
2,728,599 12/1955 Moore .
2,732,901 1/1956 Davis .
2,734,768 2/1956 Warner .
2,806,534 9/1957 Potts .
2,806,538 9/1957 Conrad .
2,965,175 12/1960 Ransom .
2,980,454 4/1961 Poteet .
3,095,926 7/1963 Rush .
3,199,906 8/1965 Chenoweth .
3,262,501 7/1966 Winger .
3,265,431 8/1966 Burner .
3,378,080 4/1968 Fredd .
3,437,370 4/1969 Bochman, Jr. et al. .
3,638,989 2/1972 Sandquist .
3,646,996 3/1972 Pearce, Jr. .
3,795,420 3/1974 Preston, Jr. .
3,856,081 12/1974 Canalizo .
3,944,273 3/1976 Ahlstone .
4,030,745 6/1977 Schoeffler et al. ..... 294/86.3
4,199,131 4/1980 Boski et al. .
4,254,983 3/1981 Harris .
4,273,372 6/1981 Sheshtawy .
4,289,202 9/1981 Henderson .
4,337,971 7/1982 Kendrick .
4,382,623 5/1983 Richardson .
4,443,130 4/1984 Hall .
4,558,895 12/1985 Tamplen .
4,574,883 3/1986 Carroll et al. .
4,585,369 4/1986 Manesse et al. .
4,616,721 10/1986 Furse .
4,646,829 3/1987 Barrington et al. .
4,664,188 5/1987 Zunkel et al. .
4,667,986 5/1987 Johnson et al. .
4,671,361 6/1987 Bolin .
4,673,041 6/1987 Turner et al. .
4,832,129 5/1989 Sproul et al. .
4,860,838 8/1989 Asak .
5,002,291 3/1991 Reed et al. .
5,024,277 6/1991 Ricles .
5,040,598 8/1991 Pleasants .
5,123,489 6/1992 Davis et al. .
5,242,201 9/1993 Beeman .

EXTERNAL PULLING TOOL AND METHOD OF OPERATION

RELATED APPLICATION

This application is a continuation-in-part of U.S. pat. application Ser. No. 08/346,258 filed Nov. 23, 1994.

FIELD OF THE INVENTION

The field of the invention relates to tools usable for retrieving objects from subterranean wells. One embodiment of the tool engages the inside of generally tubular objects and is commonly referred to in the industry as a spear or internal pulling tool, while another embodiment of the tool engages the outside of generally tubular objects and is colony referred to in the industry as an overshot or external pulling tool.

BACKGROUND OF THE INVENTION

A great variety of tools have been devised for the purpose of recovering articles dropped or broken off in oil well operations. Such lost objects are usually referred to as "fish" and the retrieval tool as a "fishing tool."

In U.S. pat. No. 5,242,201, granted to the applicant of the present invention, there is disclosed in one embodiment one form of a fishing tool known as a fishing spear. With reference to FIG. 13, the fishing spear A of the '201 patent includes an upper sub 10' having a shoulder 14' against which spring 16' bears. The opposite end of spring 16' bears on shoulder 18' formed on collet ring 20'. Collet ring 20' is mounted for translatable movement on mandrel 12'. Collet ring 20' has an outer cover 22' fixedly attached thereto. A variable volume cavity 34' is formed between collet ring 20' and mandrel 12'.

Collet ring 20' includes a plurality of collet fingers 36' with each collet finger 36' having a collet head 38' at the end thereof. Collet heads 38' are shown abutting the lower surface of mandrel 12'. More particularly, collet heads 38' are positioned against large diameter portion 40' of mandrel 12' immediately above shoulder 46'.

Fish 48' has an internal groove 50'. The outside diameter of collet heads 38', when seated against the large diameter portion 40' of mandrel 12', is larger than opening 54' of fish 48'. When spear A is used to retrieve fish 48', the end of mandrel 12' is inserted into fish 48' as shown in FIG. 13. As further seen in FIG. 14, further displacement of the end of mandrel 12' into fish 48' causes collet heads 38' to come into contact with fish 48', causing the upward displacement of collet heads 38' as the end of mandrel 12' continues to enter fish 48'. As collet heads 38' are pushed upwardly along mandrel 12' due to the engagement with fish 48', spring 16' is compressed and variable volume cavity 34' increases in volume.

A lower lip 47' is formed on the bottom of upper sub 10'. Spring 16' surrounds lower lip 46'. The expansion of variable volume cavity 34', i.e., the upward movement of collet 20', is limited by the full compression of coil spring 16'. During the upward movement of collet 20' along mandrel 12', collet heads 38' first slide along enlarged diameter portion 40' of mandrel 12', and then up inclined ramp 42'. Collet heads 38' are cammed towards reduced diameter portion 44' by fish 48' after sliding up inclined ramp 42'. Collet 20' continues to slide upwardly along mandrel 12' until spring 16' is fully compressed. A circumferential gap 24' is created between fingers 36' and cover 22'. At this point, the external diameter of collet heads 38' is less than opening 54' of fish 48', so further axial movement of spear A into fish 48' causes collet heads 38'to enter fish 48'.

When collet heads 38' are positioned within fish 48' (not shown in FIGS. 13 and 14), and more particularly when collet heads 38' are adjacent internal groove 50' in fish 48', the direction of mandrel movement is reversed. This causes collet heads 38' to slide down inclined ramp 42'. As they do so, collet heads 38' are pushed radially outwardly into internal groove 50' of fish 48'. Mandrel 12' is further raised until collet heads 38' are again positioned immediately above lower shoulder 46' of mandrel 12'. Collet heads 38' are then locked into internal groove 50' and fish 48' can be raised.

The fishing spear of the '201 patent requires an initial collision between collet heads 38' and fish 48' in order to push collet heads 38' up large diameter portion 40' and along inclined surface 42' on mandrel 12' to the point where their diameter is reduced far enough so that they can enter fish 48'. The collet ring 20' of the '201 patent is generally a relatively thin tubular body, having essentially cantilevered collet fingers 36' extending therefrom. Due to their relative thinness, collet fingers 36' inherently have low buckling strength. The repeated collisions and buckling forces sustained by collet ring 20' weakens fingers 36', sometimes to the point where fingers 36' rupture, leaving broken collet fingers 36' and collet heads 36' in the well casing.

Further, well casings are generally rather harsh environments. Debris such as sand, carbolite and scale accumulate within and on the sides of the well casing. In addition, when using wireline units, segments of wire become torn from the unit and are left in the well casing. Moreover, segments of the well casing are often attached with casing collars, which can create irregularities in the internal diameter of a well casing. Consequently, when fishing in a well casing, the tool collides with the irregularity. Still further yet, the well casing itself sometimes is not perfectly axially aligned, creating further irregularities which must be traversed by the fishing tool. These and numerous other general characteristics of well casings create hazards for fishing tools.

The '201 fishing spear design includes external operating mechanisms, including collet ring 20', cover 22' and spring 16', which reciprocate to contribute to the retraction and expansion of the collet heads 38'. Spring 16', cover 22' and shoulder 46' are exposed to the inside of the well casing. Consequently, when traveling down the well casing to engage a fish and when being pulled from well casing after the fish has been secured, sand, carbolite, scale and other debris tends to accumulate in the toroidal space defined on the outside by spring 16', on the inside by mandrel 12', at the top by lip 47' and at the bottom by shoulder 18'. Not only does the presence of these foreign substances cause spring 16' to wear, they also impact on the performance of the fishing tool by, e.g., preventing complete compression of the spring during expansion of cavity 34'.

In addition, after collet heads 38' ride up inclined surface 42' on mandrel 12' and become positioned against reduced diameter portion 44', circumferential gap 24' (FIG. 14) opens. Debris within the well casing often collects within circumferential gap 24'. The debris in gap 24' tends to wedge collet fingers 36' and collet heads 38' into the inactive position, i.e., against reduced diameter portion 44' of mandrel 12'. Under normal operations when mandrel 12' is raised after it has been inserted into fish 48', collet heads 38' ride along inclined surface 42'. Any debris within gap 24', however, tends to prevent collet fingers 36' from returning flush with casing 22'. If the collet heads 38' are forcefully returned to the active position, i.e., against enlarged diameter portion 40', collet fingers 36' may be caused to bend slightly about a point defined by the debris. In an extreme case, debris accumulates in gap 24' to the extent that collet heads 38' are prevented from sliding down inclined surface 42' and against the enlarged diameter portion 40' of mandrel 12'. In other words, the tool jams.

Still further, since the '201 fishing spear is mechanically actuated, collet heads 38' may begin sliding up mandrel 12' without encountering a fish. This could occur, for instance, if the tool traverses a misaligned casing collar. Casing collars are generally provided every 30–50 feet in the well casing. With well casings often exceeding 10,000 feet in depth, collisions between fish and misaligned casing collars are not uncommon. Thus, if any of the casing collars are out of alignment, the '201 fishing spear abuts against them, causing premature actuation of the fishing spear. While the '201 spear often successfully passes misaligned collars, gap 24' is opened to debris.

Another fishing tool disclosed in the '201 patent is depicted in FIGS. 15–18. This form a fishing tool is referred to in the industry as an overshot or an external pulling tool. For convenience, reference numerals in FIGS. 13–14 are used in FIGS. 15–18 to depict similar elements. With reference to FIG. 15, overshot A includes an upper sub 10' having a shoulder 14' against which spring 16' bears. The opposite end of spring 16' bears on shoulder 18' formed on collet ring 20'. Collet ring 20' is mounted for translatable movement on mandrel 12'. An outer cover 22' is fixedly attached to upper sub 10'. Outer cover 22' includes at the lower end thereof a lower shoulder 46', vertical small internal diameter surface 40', inclined surface 42' and vertical large diameter surface 44'. A variable volume cavity 34' is formed between collet ring 20' and mandrel 12'.

Collet ring 20' includes a plurality of collet fingers 36' with each collet finger 36' having a collet head 38' at the end thereof. Collet heads 38' rest on lower shoulder 46' of outer cover 22'. Fish 48' has an external groove 50'. The inside diameter of collet heads 38', when seated on lower shoulder 46' of cover 22', is larger than the outside diameter of fish 48'. When overshot A is used to retrieve fish 48', outer cover 22' is lowered over fish 48' as shown in FIG. 15. As further seen in FIG. 16, further displacement of overshot A causes collet heads 38' to come into contact with fish 48', causing the upward displacement of collet heads 38' along surface 40'. As collet heads 38' are pushed upwardly along surface 40', spring 16' is compressed and variable volume cavity 34' increases in volume.

During the further upward movement of collet 20' along mandrel 12', collet heads 38' then slide up inclined ramp 42'. Collet heads 38' are cammed towards vertical large diameter surface 44' by fish 48' after sliding up inclined ramp 42'. At this point, the internal diameter of collet heads 38' is greater than the external diameter of fish 48', so further axial movement of overshot onto fish 48' causes collet heads 38' to surround fish 48'.

When collet heads 38' are adjacent internal groove 50' in fish 48' (FIG. 17), the direction of overshot movement is reversed. This causes collet heads 38' to slide down inclined ramp 42'. As they do so, collet heads 38' are pushed radially inwardly into external groove 50'. Overshot A is further raised until collet heads 38' rest on top of lower shoulder 46' (FIG. 18). Collet heads 38' are then locked into external groove 50' and fish 48' can be raised.

As with the first prior art embodiment, overshot A requires an initial collision between collet heads 38' and fish 48' in order to push collet heads 38' up surface 40' and along inclined surface 42'. The repeated collisions and buckling forces sustained by collet ring 20' weakens fingers 36'.

These and other disadvantages of the fishing spear and overshot of the '201 patent are addressed by the improved fishing spear and overshot/external pulling tool of the claimed invention.

SUMMARY OF THE INVENTION

It is an object of one of the preferred embodiments to provide a fishing spear in which the reciprocating mechanism is internally contained within the spear.

It is a further object of one of the preferred embodiments to provide a fishing spear which cannot be activated by irregularities in the well casing.

Another object of one of the preferred embodiments is to provide a fishing spear which is not susceptible to jamming due to debris and other contaminants within the well casing.

Yet another object of the preferred embodiments is to provide a fishing spear and an external pulling tool having collet fingers which are not subjected to collisions with the fish and misalignments in the well casings.

These and other objects of the preferred embodiments are provided by a fishing spear having a mandrel interconnected to an upper sub. The mandrel and upper sub form a support body for the spear. The mandrel includes an upper body portion having a first outer diameter and a lower body portion having a second outer diameter, which is greater than the first outer diameter. A projecting head is formed at the bottom of the mandrel. A shoulder is formed between the projecting head and the second diameter portion of the mandrel. The projecting head has an inclined surface at the bottom thereof which facilitates inserting the spear into the fish. Axially aligned bores are formed through the mandrel and the upper sub. A check ball valve is retained within the bottom of the mandrel by a hex-shaped restrict plug. A plurality of fluid bleed passages extend from the top of the hex-shaped restrict plug to the bottom of the inclined surface at the bottom of the projecting head.

A collet assembly is telescopically positioned outside of the mandrel and is secured to the upper sub. The collet assembly comprises a plurality of collet fingers, with each collet finger having a collet head at the end thereof. The collet fingers are naturally radially inwardly biased. The collet heads have inner, inclined surfaces and outer, inclined surfaces. A recess is formed on the inside of each collet finger above the collet heads. The collet heads and the collet fingers form a gripping device for selectively gripping the fish.

A substantially annular support sleeve is telescopically positioned around the mandrel between the collet assembly and the mandrel. The support sleeve includes an upper head portion, an intermediate body portion and a lower foot portion. A coil spring is positioned between the upper head portion and the upper sub. The coil spring urges the support sleeve downwardly along the mandrel so that the lower foot portion rests on the shoulder on the projecting head. The lower foot portion of the support sleeve outwardly biases the collet heads so that when the variable volume cavity expands to cause the lower foot portion to rise along the mandrel, the collet heads radially retract so that they are positioned against the mandrel.

The variable volume cavity is formed between the support sleeve and the mandrel. A radial fluid communication path extends between the bore in the mandrel and the variable volume cavity. When the fishing tool is used to retrieve a fish in a wellbore, the spear is lowered until the projecting head gently bumps against the fish. At this time fluid pressure is supplied to the bores in the mandrel and the upper sub. Some of the fluid enters the variable volume cavity. Eventually, the fluid pressure in the variable volume cavity overcomes the downwardly biasing force of the coil spring, causing the support sleeve to rise along the mandrel. In doing so, the lower foot portion of the support sleeve slides up the collet heads until it is positioned in the recess on the inside of the collet fingers. The collet heads then move radially inwardly against the mandrel, and the spear is inserted into the fish.

After the spear is within the fish, fluid pressure is no longer supplied to the inside of the bores in the upper sub and the mandrel. Eventually the spring force overcomes the fluid pressure in the variable volume cavity such that the support sleeve is pushed downwardly. The lower foot portion of the support sleeve biases the collet heads radially outwardly and the spear is raised. The outer inclined surface of the collet heads then engage the inside of the fish, which is in turn raised from the well casing. It will be readily appreciated that the provision of the support sleeve on the outside of the mandrel provides a selectively radially biasing force inasmuch as the lower foot portion of the support sleeve wedges the collet heads outwardly. In order to free the fish in the event that it becomes stuck in the well, the process is substantially reversed.

In an alternative embodiment, the fishing spear is outfitted with a self-cleaning mechanism. The self-cleaning mechanism comprises a plurality of fluid passages extending through the mandrel. At one end, the fluid passages open above the fluid bleed passages, while at their other end, the fluid passages open behind the lower foot portion of the support sleeve when the support sleeve is resting on top of the shoulder at the bottom of the mandrel. Fluid pressure can be selectively applied to the fishing spear through the mandrel, some of which flows through the self-cleaning fluid passages and some of which flows through the bleed passages. Accordingly, the area behind the support sleeve is washed or flushed by the fluid delivered through the self-cleaning fluid passages.

An external pulling tool according to a first preferred embodiment comprises a mandrel interconnected to an upper sub. The mandrel includes an upper small diameter portion, a lower larger diameter portion and a shoulder formed between the small and large diameter portions. A collet ring surrounds the lower end of the mandrel. An annular support sleeve extends past the upper end of, and surrounds, the collet ring. The support sleeve includes an upper head portion, upper and lower intermediate body portions and a lower body portion. A variable volume cavity is formed between the support sleeve and the mandrel and is defined by the small diameter portion of the mandrel, the upper intermediate body portion of support sleeve and the shoulder between the small and large diameter portions of the mandrel.

An outer cover is fixedly secured to the upper sub and surrounds the support sleeve and the collet ring. The outer cover includes a lower shoulder formed at the bottom thereof. A stop sleeve is positioned around the mandrel in abutting relationship with the bottom of the upper sub. A coil spring is disposed in the area defined between the stop sleeve and the outer cover. The coil spring has one end in engagement with a lip formed at the bottom of upper sub while the other end is in engagement with the head portion of the support sleeve.

Axially aligned bores are formed through the upper sub and the mandrel and a radial communication path extends from one of the axial bores to the expandable cavity. When fluid is supplied to the axial bores and into the expandable cavity, the support sleeve rises and compresses the coil spring until the head portion of the support sleeve abuts the bottom of the stop sleeve. When fluid pressure is terminated, the recoil strength of the coil spring overcomes the fluid pressure, pushing the support sleeve downwardly until the bottom of the lower body portion rests against the lower shoulder on the outer cover.

The collet assembly comprises a plurality of collet fingers, with each collet finger having a collet head at the end thereof. The collet fingers are naturally outwardly radially biased. The collet heads have inner, inclined surfaces and outer, inclined surfaces. The collet heads and the collet fingers form a gripping device for selectively gripping an external fishing neck.

When the external pulling tool is used to retrieve a fish from the well, the external pulling tool is lowered until the bottom thereof gently bumps against the top of the fish. At this time, fluid pressure is supplied to the bores in the mandrel and the upper sub. Some of the fluid enters the variable volume cavity. Eventually, the fluid pressure in the variable volume cavity overcomes the downwardly biasing force of the coil spring, causing the support sleeve to rise along the mandrel. In doing so, the lower body of the support sleeve slides up the collet heads until the head portion on the support sleeve abuts the bottom of stop sleeve. The collet heads, under the radial inward bias of the collet fingers, expand radially outwardly into contact with the inner surface of the outer cover. At this time, the inner diameter of the collet heads is greater than the outer diameter of the external fishing neck, and the external pulling tool is lowered on top of the fish.

After the external pulling tool is positioned around the external fishing neck, fluid pressure is no longer supplied to the inside of the bores in the upper sub and the mandrel. Eventually the spring force overcomes the fluid pressure in the variable volume cavity such that the support sleeve is pushed downwardly. The bottom of the lower body portion of the support sleeve biases the collet heads radially inwardly, and the external pulling tool is raised. The inner inclined surfaces of the collet heads then engage the external fishing neck, which is in turn raised from the well casing. In order to free the fish in the event that it becomes stuck in the well casing, the process is substantially reversed.

In an alternative embodiment, the external pulling tool is outfitted with a self-cleaning mechanism. The self-cleaning mechanism comprises a plurality of fluid passages extending through the mandrel. At one end, the fluid passages open inside of the mandrel near the bottom thereof, while at their other end, the fluid passages open into the space below the mandrel formed within the outer cover. Fluid pressure can be selectively applied to the external pulling tool through the mandrel, which then flows through the self-cleaning fluid passages. Accordingly, the area behind the support sleeve is washed or flushed by the fluid delivered through the self-cleaning fluid passages.

These and other features and objects of the present invention will become apparent when the specification is read in conjunction with the accompanying drawings.

DETAILED DESCRIPTION OF THE PREFERRED EMBODIMENTS

Figure 1:
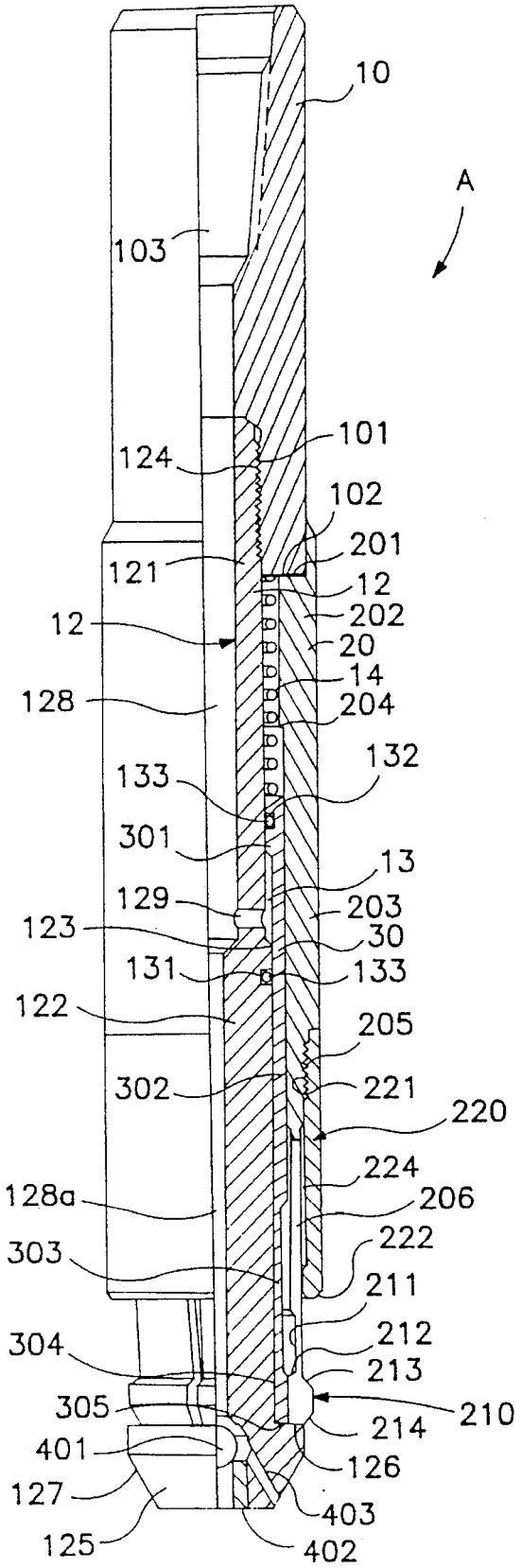
FIG. 1 is a partial cross sectional elevational view of a fishing spear according to a first preferred embodiment showing the support sleeve resting against the top of the projecting head and the collet heads in expanded position.
Figure 2:
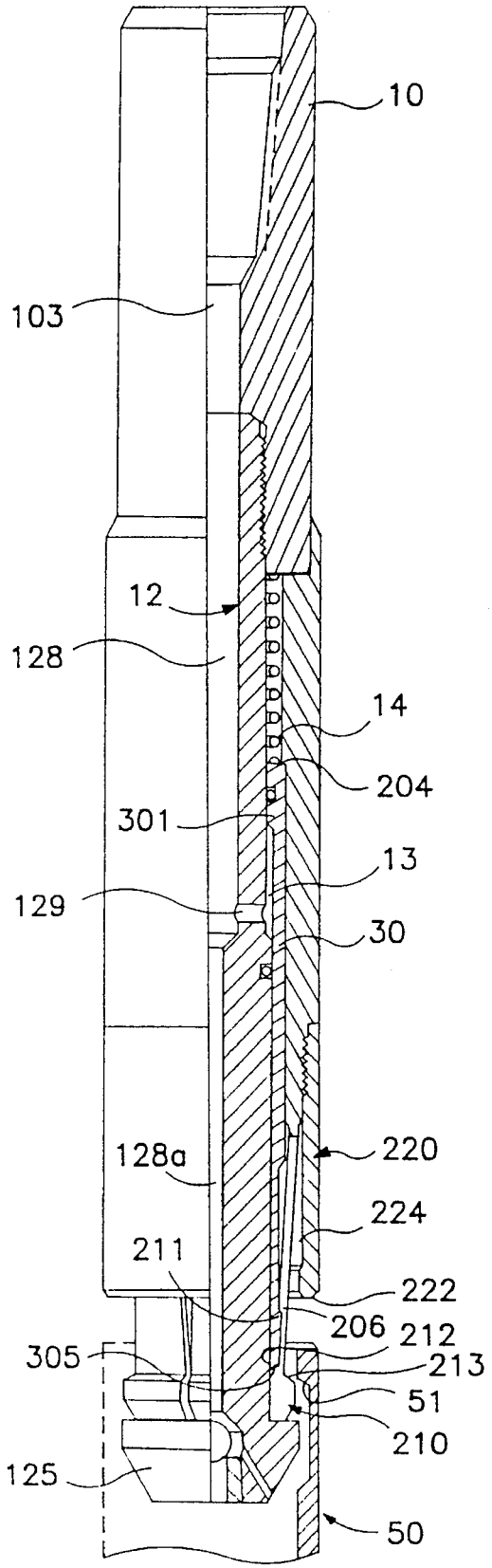
FIG. 2 is a partial cross sectional elevational view of the fishing spear according to the first preferred embodiment showing the support sleeve in a raised position and the collet heads in the retracted position.

With reference to FIG. 1, the fishing spear apparatus A according to the preferred embodiment comprises a mandrel 12 received within an upper sub 10, a substantially annular collet 20 telescopically surrounding mandrel 12, and a substantially annular support sleeve 30 telescopically surrounding mandrel 12 and disposed between collet 20 and mandrel 12. Mandrel 12 has an upper small diameter portion 121 and a lower larger diameter portion 122. A shoulder 123 is formed between the small and large diameter portions 121, 122. The top of the small diameter portion 121 is externally threaded at 124. The small diameter portion 121 is received by complimentary internal threads 101 on upper sub 10. Upper sub 10 has a lower lip 102 extending beyond its threaded engagement with small diameter portion 121. At its lower end, mandrel 12 is formed with a projecting head 125. Projecting head 125 includes a shoulder 126 extending outwardly from the large diameter portion 122 and a tapered outer surface 127 to facilitate insertion of projecting head 125 into fish 50 (FIG. 2). The outer diameter of projecting head 125 is smaller than the opening of fish 50.

Mandrel 12 and upper sub 10 have bores 128, 103 formed therein. In addition, mandrel 12 has a reduced diameter bore **128*a* formed in axial alignment with bores 128, 103. Bores 128, 128*a*, 103 define a fluid passageway extending through mandrel 12 and upper sub 10. A check ball valve 401 (FIG. 1) rests on a removable hexshaped restrict plug 402 at the bottom of mandrel 12. A plurality of bleed passages 403, preferably four, angularly extend from the top of restrict plug 402 to the bottom of tapered surface 127 of projecting head 125. Well pressure generally generated from below the fishing spear is prevented from activating the fishing spear by the engagement of check ball valve 401 against the bottom of the reduced diameter portion of bore 128*a*. In the event that the well pressure is known to be insufficient to cause the fishing spear to activate, check ball valve 401 may be removed before lowering spear A by unscrewing hexshaped restrict plug 402**.

Annular support sleeve 30 includes an upper head 301, an upper intermediate body portion 302 of lesser thickness than head 301, a lower intermediate body portion 303 of lesser thickness than upper intermediate body portion 302 and a lower foot portion 304 of substantially the same thickness as upper intermediate body portion 302. Lower foot portion 304 is preferably chamfered at 305. Support sleeve 30 is slidably received between mandrel 12 and collet 20. A coil spring 14 is positioned between the top of head 301 and the lower lip 102 on upper sub 10. Coil spring 14 tends to bias support sleeve 30 in the direction of projecting head 125 so that lower foot portion 304 is restrained against further downward movement by shoulder 126.

A fluid communication path 129 is formed radially through mandrel 12. Fluid communication path 129 opens at one end into bore 128 and at the other end into an expandable cavity 13, which is defined by small diameter portion 121 of mandrel 12, upper head 301, upper intermediate body portion 302 of support sleeve 30 and shoulder 123. A recess 131 is formed on the outside of mandrel 12 in the vicinity of, but below, fluid communication path 129. A recess 132 is also formed on the inside surface of upper head 301. O-ring seals 133 are positioned within recesses 131, 132 to seal the mating surfaces between support sleeve 30 and mandrel 12 to maintain the fluid tight integrity of expandable cavity 13.

Collet 20 has an upper shoulder 201 seated against lower lip 102 of upper sub 10. Collet 20 and upper sub 10 are secured by any manner known in the art, e.g., a threaded or splined connection. Collet 20 includes an upper portion 202 having a first inner diameter and intermediate portion 203 having a second inner diameter greater than the inner diameter of the upper portion 202. A shoulder 204 is formed between the upper and intermediate portions 202, 203. Collet 20 further includes an externally threaded portion 205 below intermediate portion 203 and a finger assembly having a plurality of fingers 206, preferably six, extending below externally threaded portion 205.

Each finger 206 in the assembly is provided with a collet head 210 at the end thereof. A recess 211 is provided on the inside periphery of each finger 206 just above collet heads 210. The axial length of recess 211 is slightly larger than the axial length of lower foot portion 304 of support sleeve 30. Each collet head 210 has an inner, downwardly inclined surface 212 extending from recess 211. On their outer periphery, collet heads 210 have downwardly and outwardly inclined surfaces 213 and upwardly inclined surfaces 214. Collet assembly 20 is preferably sized so that the bottom of the collet heads 210 extend substantially to the shoulder 126 of projecting head 125. Collet fingers 206 are preferably naturally inwardly biased so that when support sleeve 30 is raised, collet heads 210 abut mandrel 12. Alternatively, collet fingers 206 may be formed straight so that when the spear encounters fish 50 and support sleeve 30 is raised, outer inclined surfaces 214 are cammed by fish 50 inwardly in the direction of mandrel 12.

An outer cover sleeve 220 partially surrounds fingers 206. Outer cover sleeve 220 is internally threaded at 221 for securement to collet 20 through external threads 205. A lower lip 222 is formed at the bottom of cover sleeve 220. Lower lip 222 curves inwardly so that a space 224 is formed between the outside of collet fingers 206 and the inside of cover sleeve 220. While debris might enter space 224 while collet heads 210 are in the inactive position (FIG. 2), debris generally does not accumulate to the extent that spear becomes jammed. Moreover, outer cover sleeve 220 has substantially the same outer diameter as collet assembly 20 and all of the reciprocating parts are contained within collet assembly 20 and outer cover 220. The coextensive outer diameters of collet assembly 20 and outer cover 220 facilitates the insertion and removal of the fishing spear A from the well casing, and protects the internal reciprocating parts, e.g., the support sleeve 30 and spring 14, during travel through the relatively harsh well casing environment.

When an object is to be retrieved from an oil well, spear A is preferably lowered until the bottom of projecting head 125 bumps against fish 50. Then, spear A is raised several feet, and fluid pressure pumped into axial bores 103, 128, **128*a* extending through upper sub 10 and mandrel 12. Some of the fluid pumped into axial bores 103, 128, 128*a* flows through fluid communication path 129 and into expandable cavity 13. Excessive fluid pressure leaks through passages 403 and spaces between ball 401 and hexshaped restrict plug 402. The fluid pressure within expandable cavity 13 causes support sleeve 30 to rise against the biasing force of coil spring 14. Support sleeve 30 continues to rise until the top of upper head portion 301 contacts shoulder 204. During this time, lower foot portion 304 of support sleeve 30 rises along the inner surface of collet head 210. When lower foot portion 304 rises to the point where chamfer 305 meets inner, downwardly inclined surface 212, collet heads 210, which are preferably naturally inwardly biased, begin moving radially inwardly in the direction of large diameter portion 122 of mandrel 12. As collet heads 210 move radially inwardly towards mandrel 12, chamfer 305 slides upwardly along inclined surface 212. When upper head 301 is seated against shoulder 204, lower foot portion 304 of support sleeve 30 is received within inner recess 211 of collet fingers 206. The inwardly biased collet fingers 206 bend in the direction of mandrel 12 such that their outer diameter is now less than the opening of fish 50**.

As best seen in FIG. 2, with collet fingers 206 now in the retracted position, i.e., with fluid pressure causing support sleeve 30 to partially compress coil spring 14 so that head 301 is seated against shoulder 204, spear A is slowly lowered into fish 50. A signal is sent to the operator indicating when lip 222 at the bottom of cover sleeve 220 bumps against fish 50. This informs the operator that projecting head 125 and collet heads 210 are fully received within fish 50. Then, the high pressure fluid is no longer supplied to internal bores 103, 128, **128*a* in upper sub 10 and mandrel 12. Consequently, coil spring 14 overcomes the fluid pressure within expandable cavity 13, causing support sleeve 30 to slide along mandrel 12. In doing so, chamfer 305 on lower foot portion 304 of support sleeve 30 slides downwardly along the inner, downwardly inclined surface 212 of collet heads 210, wedging the collet heads 210 into the active position. Then, upper sub 10 and mandrel 12 are raised, causing the outer, downwardly inclined surface 213 of collet heads 210 to engage downwardly inclined surface 51 on fish 50**.

If before or during the process of raising fish 50 from the wellbore, fish 50 becomes stuck and cannot be freed without damaging spear A, spear A can be released from fish 50 as follows: first, upper sub 10 and mandrel 12 are lowered until lower lip 222 on cover sleeve 220 rests on fish 50. In this manner, substantially all of the weight of upper sub 10, mandrel 12 and drill string (not shown) are resting on fish 50. Fluid pressure is then pumped into bores 103, 128, **128*a* extending through upper sub 10 and mandrel 12. Some of the fluid enters expandable cavity 13 through fluid communication path 129, causing support sleeve 30 to rise against the downwardly biasing force of coil spring 14. Support sleeve 30 continues to rise until upper head portion 301 seats against shoulder 204. At the same time, chamfer 305 on lower foot portion 304 of support sleeve 30 rides up the inner, downwardly inclined surface 212 of collet heads 210. As lower foot portion 304 of support sleeve 30 enters inner recess 211 of collet fingers 206, collet heads 210 assume their natural inwardly biased configuration, which has a smaller outer diameter than the opening of fish 50. Consequently, spear A can be raised out of fish 50 and further measures taken to free fish 50** from the wellbore.

Figure 3:
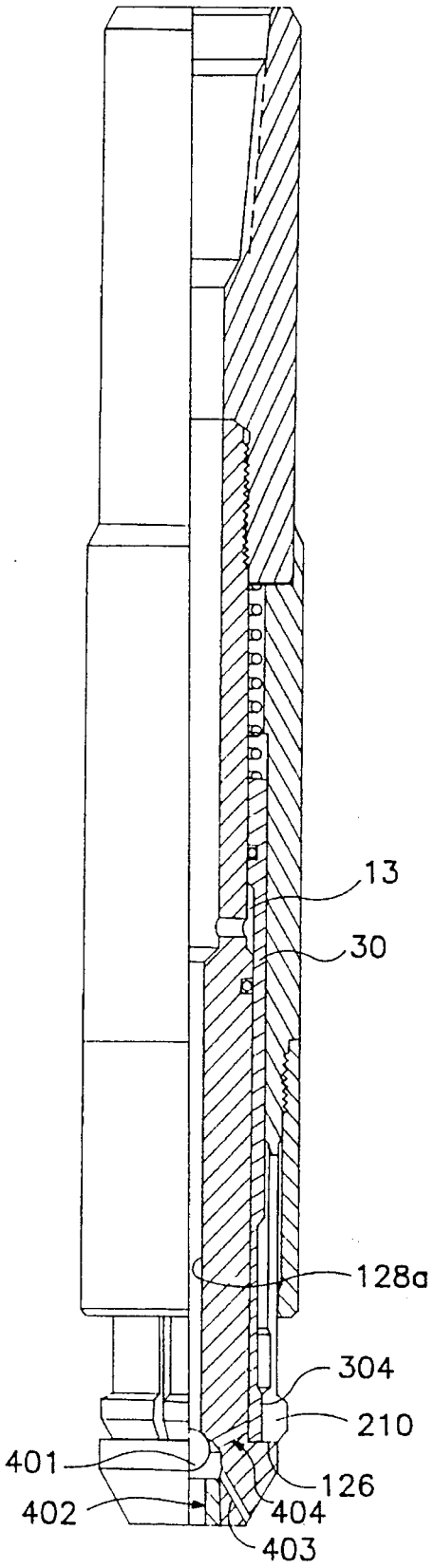
FIG. 3 is a partial cross sectional elevational view of a fishing spear according to a second preferred embodiment having a self-cleaning mechanism and showing the support sleeve resting against the top of the projecting head and the collet heads in the expanded position.
Figure 4:
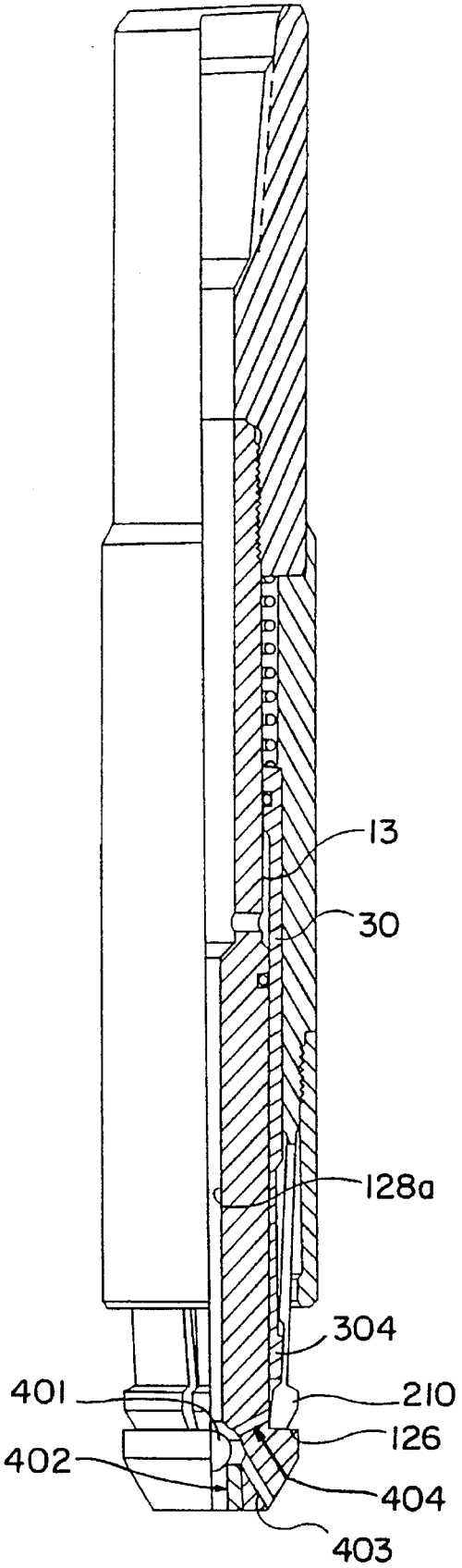
FIG. 4 is a partial cross sectional elevational view of the fishing spear according to the second preferred embodiment showing the support sleeve in a raised position and the collet heads in the retracted position.

With further reference to FIGS. 3–4, a fishing spear according to a second preferred embodiment is shown. The discussion is primarily reserved for features in the fishing spear (or internal pulling tool) of the second preferred embodiment differing from those in the first preferred embodiment. Otherwise, the same reference numerals are used to designate similar parts. In FIG. 3, the pulling tool is depicted in the run-in position with support sleeve 30 in the lowered position and collet heads 210 expanded. In FIG. 4, the pulling tool is depicted in the release position with support sleeve 30 in the raised position and collet heads 210 retracted.

The fishing spear/external pulling tool of the second preferred embodiment includes a self-cleaning mechanism. The self-cleaning mechanism comprises a plurality of fluid passages 404 having an open end formed between the bottom of bore **128*a* and the top of bleed passages 403 and another open end disposed behind foot portion 304 of support sleeve 30. Lower foot portion 304 of support sleeve 30 substantially closes the opening of fluid passage 404 when seated on top of lower shoulder 126. Thus, when the pulling tool is lowered into the well casing, the fluid pressure beneath the pulling tool, if of sufficient strength, causes check ball 401 to seat against the bottom of bore 128*a*. Fluid flowing through the bore in the hex-shaped restrict plug 402 accumulates in fluid passages 404. However, since fluid passages 404 are closed by lower foot portion 304 of support sleeve 30**, fluid and debris beneath the pulling tool does not enter or foul the moving parts of the tool.

The pulling tool may be selectively cleaned by supplying fluid pressure to bores 128, **128*a* extending within mandrel 12. The fluid pressure forces check ball 401 against hexshaped restrict plug 402. Thereafter, support sleeve 30 begins to rise while expandable cavity 13 fills with fluid. When lower foot portion 304 of support sleeve 30 rises, fluid passages 404 open. Some of the fluid flowing through bores 128, 128***a* flows through passages 403, 404. The fluid flowing through passages 404 washes or flushes debris and other foreign matter from the area behind collet heads 210.

Figure 6:
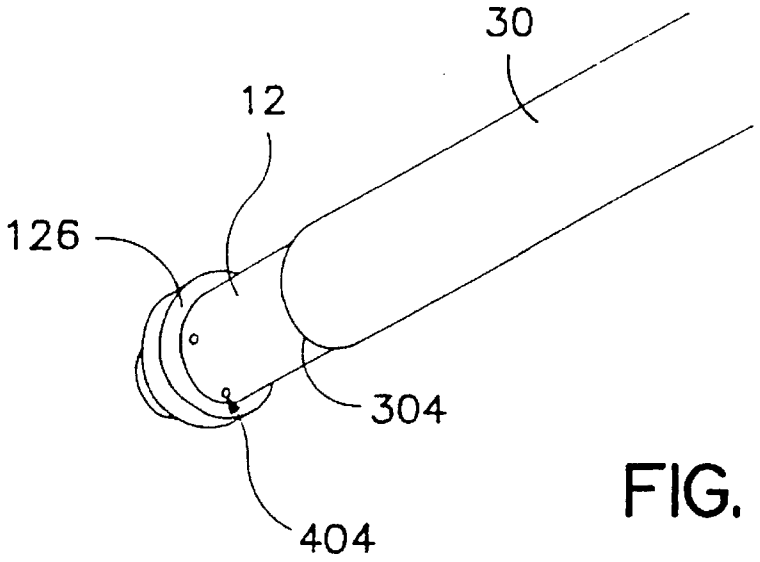
FIG. 6 is a schematic isometric view of a mandrel for a self-cleaning fishing spear showing the support sleeve in the raised position.
Figure 5:
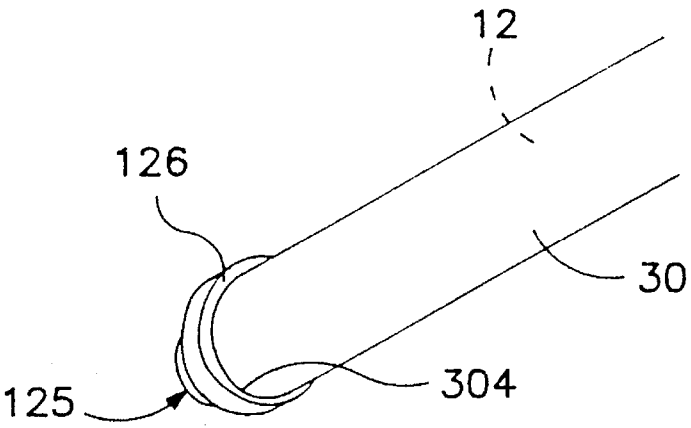
FIG. 5 is a schematic isometric view of a mandrel for a self-cleaning fishing spear showing the support sleeve in the lowered position.

With reference to FIGS. 5 and 6, there is shown a portion of the self-cleaning pulling tool assembly according to the second preferred embodiment. With particular reference to FIG. 5, support sleeve 30 surrounds mandrel 12 so that lower foot portion 304 rests against shoulder 126 on projecting head 125. With support sleeve 30 in this position, passages 404 are closed. However, as shown in FIG. 6, when support sleeve 30 is raised, lower foot portion 304 uncovers passages 404. Fluid can then flow out passages 404 and flush the areas between the collet heads (not shown) and support sleeve 30.

It will be readily appreciated by those of ordinary skill in the art that the fishing spear according to the preferred embodiments has no external reciprocating mechanisms that can get fouled by debris within the wellbore. Rather, the tool according to the preferred embodiments advantageously encases the reciprocating parts. In addition, if debris does happen to enter the preferred fishing tools, the circumferential space 224 between the inside of cover sleeve 220 and the outside of collet fingers 206 sufficiently accommodates it, thus preventing the tool from becoming jammed. Still further yet, since the tool is hydraulically actuated for entry into fish 50, the relatively thin collet fingers 206 are relieved from repeated collisions with the fish and are exposed to little if any excessive buckling forces when entering fish 50. In addition, the continuous outside diameter of cover sleeve 220 and collet assembly 20 facilitates the tool's travel within the well casing. Still further, the hydraulic nature of the tool allows the operator to repeatedly engage and release the fish without first having to pull the fishing tool from the wellbore. Such repeated engagement and release might be necessary if the fish becomes temporarily wedged within the wellbore. This is significant when it is considered that the fish is often at depths exceeding 10,000 feet within the wellbore.

Figure 7:
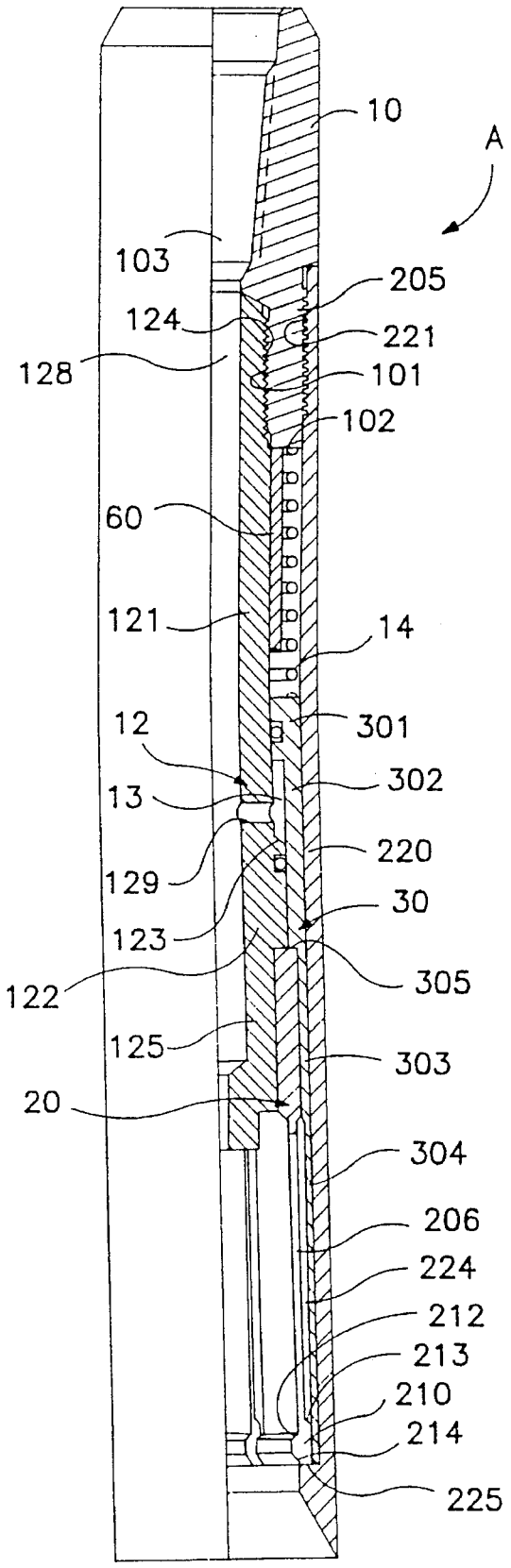
FIG. 7 is a partial cross sectional elevational view of an external pulling tool according to a first preferred embodiment showing the support sleeve resting against the top of the lower shoulder on the outer cover and the collet heads in the active position.

With reference to FIG. 7, an external pulling tool A (also known as an overshot) according to the preferred embodiment is shown. For convenience, elements of the external pulling tool which are similar to elements in the fishing spear of FIGS. 1–2 are designated with the same numerals and the discussion is reserved primarily for the features that differ between the spear and the external pulling tool. External pulling tool A comprises a mandrel 12 received within upper sub 10, a substantially annular collet 20 telescopically surrounding the bottom of mandrel 12, and a substantially annular support sleeve 30 telescopically surrounding collet 20. Mandrel 12 has an upper small diameter portion 121, an intermediate larger diameter portion 122 and a lower small diameter portion 125. A shoulder 123 is formed between upper small diameter portion 121 and intermediate large diameter portion 122. The top of the small diameter portion 121 is externally threaded at 124. The small diameter portion 121 is received by complimentary internal threads 101 on upper sub 10. Upper sub 10 is formed with a lower lip 102. A coil spring 14 is positioned between lower lip 102 and the top of support sleeve 30.

An outer cover 220 surrounds support sleeve 30, collet 20 and mandrel 12. Outer cover 220 includes internal threads 221 at the top thereof which engage external threads 205 on upper sub 10. Outer cover 220 has a support surface 225 at the bottom thereof. Collet heads 210 are positioned on top of support surface 225. Support sleeve 30 is formed with an upper head 301, an upper intermediate body portion 302 of lesser thickness than head 301, a lower intermediate body portion 303 of lesser thickness than upper intermediate body portion 302 and a lower body portion 304 of lesser thickness than lower intermediate body portion 303. A shoulder 305 is formed between upper intermediate body portion 302 and lower intermediate body portion 303.

A stop sleeve 60 surrounds small diameter portion 121 of mandrel 12 and is positioned inside of spring 14. The reciprocative motion of support sleeve 30 within outer cover 220 is defined by the engagement of head 301 with the bottom of stop sleeve 60 and by the engagement of shoulder 305 with the top of collet 20. When no fluid is supplied to variable volume cavity 13 through bores 103, 128 and fluid communication path 129, support sleeve 30 is downwardly biased by coil spring 14 so that the bottom of lower body portion 304 rests against support surface 225. In this position, shoulder 305 abuts the top of collet 20. Collet fingers 210 are preferably naturally outwardly radially biased. Consequently, when coil spring 14 is fully extended so that support sleeve 30 is positioned as shown in FIG. 3, support sleeve 30 cams collet heads 210 into the active position. When fluid is supplied to variable volume cavity 13 through bores 103, 128 and fluid communication path 129, support sleeve 30 begins to rise as variable volume cavity 13 expands. The upward movement of support sleeve 30 is limited by the engagement of head 301 with the bottom of stop sleeve 60. At this time, the bottom of lower body portion 304 of support sleeve 30 is located above collet heads (FIG. 8), so collet fingers 206, which are naturally outwardly radially biased, expand against the inside surface of outer cover 220. Alternatively, collet fingers 206 may be formed straight so that when the external pulling tool encounters the fish and support sleeve 30 is raised, inner inclined surfaces 214 are cammed outwardly by the fish so that collet heads 210 are positioned against the inside surface of outer cover 220.

When an object is to be retrieved from a well, external pulling tool A is preferably lowered until the bottom of outer cover 220 bumps against the external fishing neck (not shown). Then, external pulling tool A is raised several feet, and fluid pressure is pumped into axial bores 103, 128 extending through upper sub 10 and mandrel 12. Some of the fluid pumped into axial bores 103, 128 flows through fluid communication path 129 and into expandable cavity 13. The fluid pressure within expandable cavity 13 causes support sleeve 30 to rise against the biasing force of coil spring 14. Support sleeve 30 continues to rise until the top of head 301 contacts stop sleeve 60. During this time, the bottom of lower body portion 304 of support sleeve 30 rises along the outer surface of collet heads 210. When the bottom of lower body portion 304 meets outer, downwardly inclined surface 213, collet heads 210, which are preferably naturally outwardly biased, begin moving radially outwardly in the direction of outer cover 220. As collet heads 210 move radially outwardly, the bottom of lower body portion 304 slides upwardly along inclined surface 2 13. The outwardly biased collet fingers 206 bend in the direction of outer cover 220 such that the inner diameter of collet heads 210 is now greater than the outer diameter of the external fishing neck.

Figure 8:
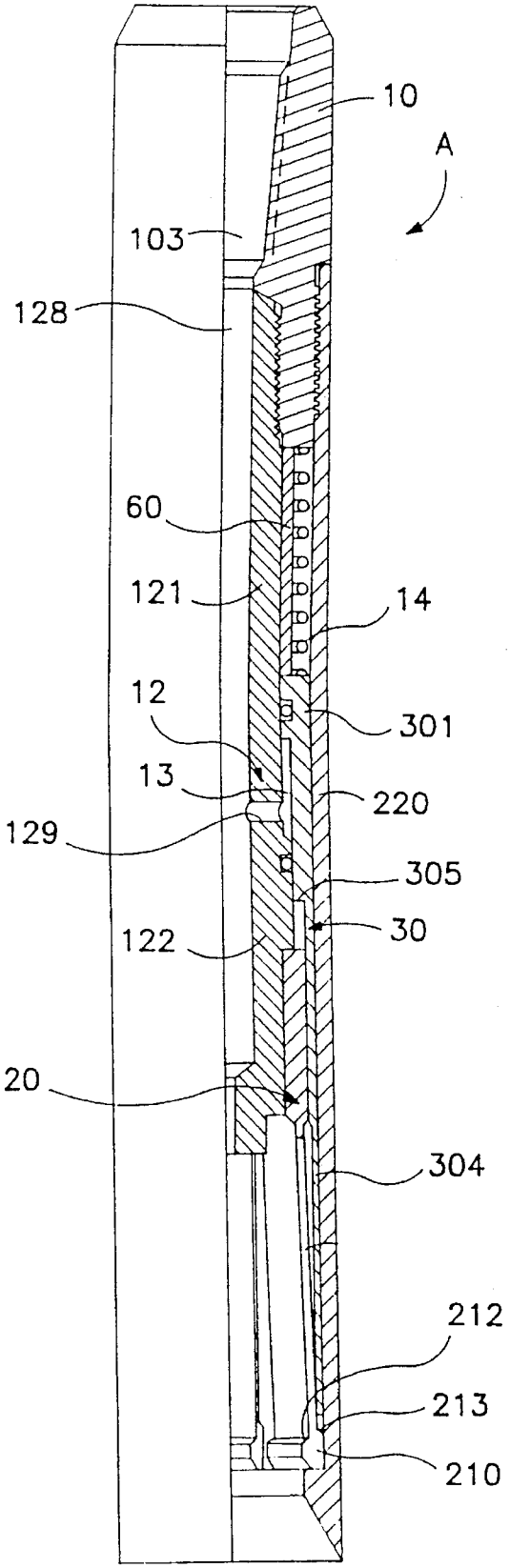
FIG. 8 is a partial cross sectional elevational view of the external pulling tool according to the first preferred embodiment showing the support sleeve in a raised position and the collet heads in the inactive position.

As best seen in FIG. 8, with collet fingers 206 now in the inactive position, i.e., with fluid pressure causing support sleeve 30 to partially compress coil spring 14 so that head 301 is seated against stop sleeve 60, external pulling tool A is slowly lowered onto the external fishing neck. A signal is sent to the operator indicating when the external fishing neck is fully received within external pulling tool A. Then, the high pressure fluid is no longer supplied to internal bores 103, 128 in upper sub 10 and mandrel 12. Consequently, coil spring 14 overcomes the fluid pressure within expandable cavity 13, causing support sleeve 30 to slide along mandrel 12. In doing so, the bottom of lower body portion 304 of support sleeve 30 slides downwardly along the outer, downwardly inclined surface 213 of collet heads 210, wedging the collet heads 210 into the active position. Then, upper sub 10 and mandrel 12 are raised, causing the inner, downwardly inclined surface 212 of collet heads 210 to engage the external fishing neck.

If before or during the process of raising the fish from the wellbore, the fish becomes stuck and cannot be freed without damaging external pulling tool A, external pulling tool A can be released from the fish as follows: first, upper sub 10 and mandrel 12 are lowered until the bottom of outer cover 220 rests on the fish. In this manner, substantially all of the weight of upper sub 10, mandrel 12 and drill string (not shown) are resting on the fish. Fluid pressure is then pumped into bores 103, 128 extending through upper sub 10 and mandrel 12. Some of the fluid enters expandable cavity 13 through fluid communication path 129, causing support sleeve 30 to rise against the downwardly biasing force of coil spring 14. Support sleeve 30 continues to rise until head 301 seats against stop sleeve 60. At the same time, the bottom of lower body portion 304 rides up the outer, downwardly inclined surface 213 of collet heads 210. Collet heads 210 then assume their natural outwardly radially biased configuration, which has a larger inner diameter than the outer diameter of the fish. Consequently, external pulling tool A can be raised off of the fish and further measures taken to the free the fish from the wellbore.

Figure 9:
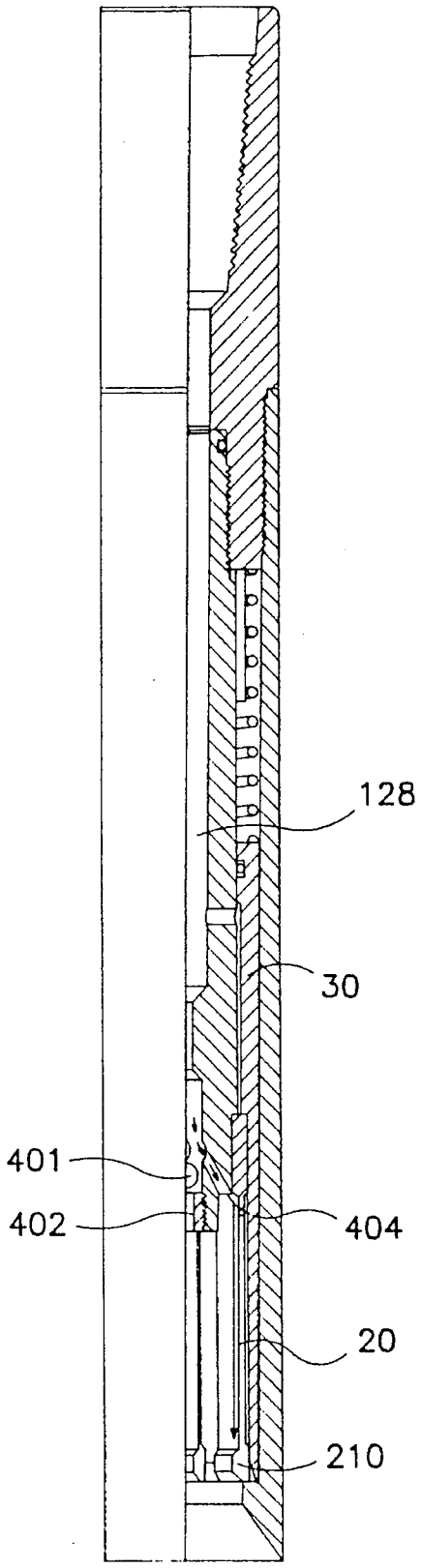
FIG. 9 is a partial cross sectional elevational view of an external pulling tool according to a second preferred embodiment having a self-cleaning mechanism and showing the support sleeve resting against the top of the lower shoulder on the outer cover and the collet heads in the active position.

With further reference to FIG. 9, an external pulling tool according to a further preferred embodiment is shown. The discussion is primarily reserved for features in the external pulling tool of the further preferred embodiment differing from those in the first preferred embodiment. Otherwise, the same reference numerals are used to designate similar parts. In FIG. 9, the pulling tool is depicted in the run-in position with the support sleeve 30 in the lowered position and collet heads 210 inwardly radially biased.

The overshot/external pulling tool of the second preferred embodiment includes a self-cleaning mechanism. The self-cleaning mechanism comprises a plurality of fluid passages 404 extending from the bottom of bore 128 in mandrel 12 and the inside of the space defined by collet assembly 20. The pulling tool may be selectively cleaned by supplying fluid to bore 128 extending within mandrel 12. The fluid pressure forces check ball 401 against hex-shaped restrict plug 402. Some of the fluid flowing through passage 128 flows through passages 404. The fluid flowing through passages 404 washes or flushes debris and other foreign matter from the area behind collet heads 210.

Figure 12:
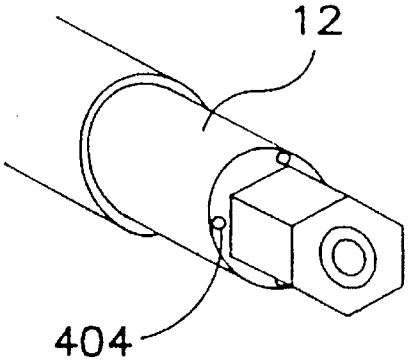
FIG. 12 is a schematic isometric view of the mandrel of the self-cleaning external pulling tool of the second preferred embodiment.
Figure 11:
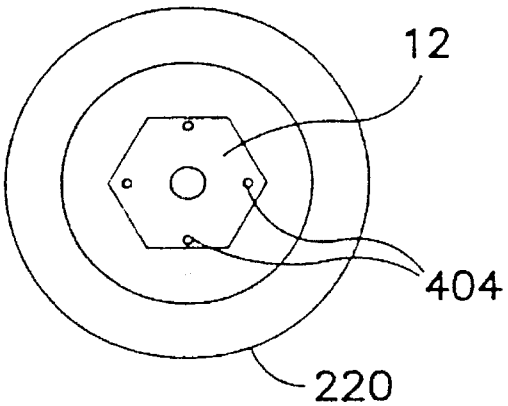
FIG. 11 is a schematic cross sectional view of the external pulling tool according to the second preferred embodiment in the release position.
Figure 10:
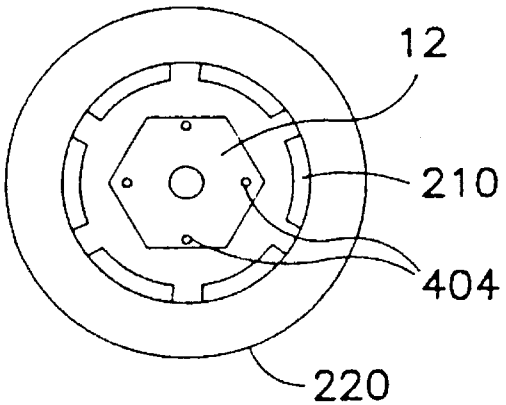
FIG. 10 is a schematic cross sectional view of the external pulling tool according to the second preferred embodiment in the run in position.
Figure 13:
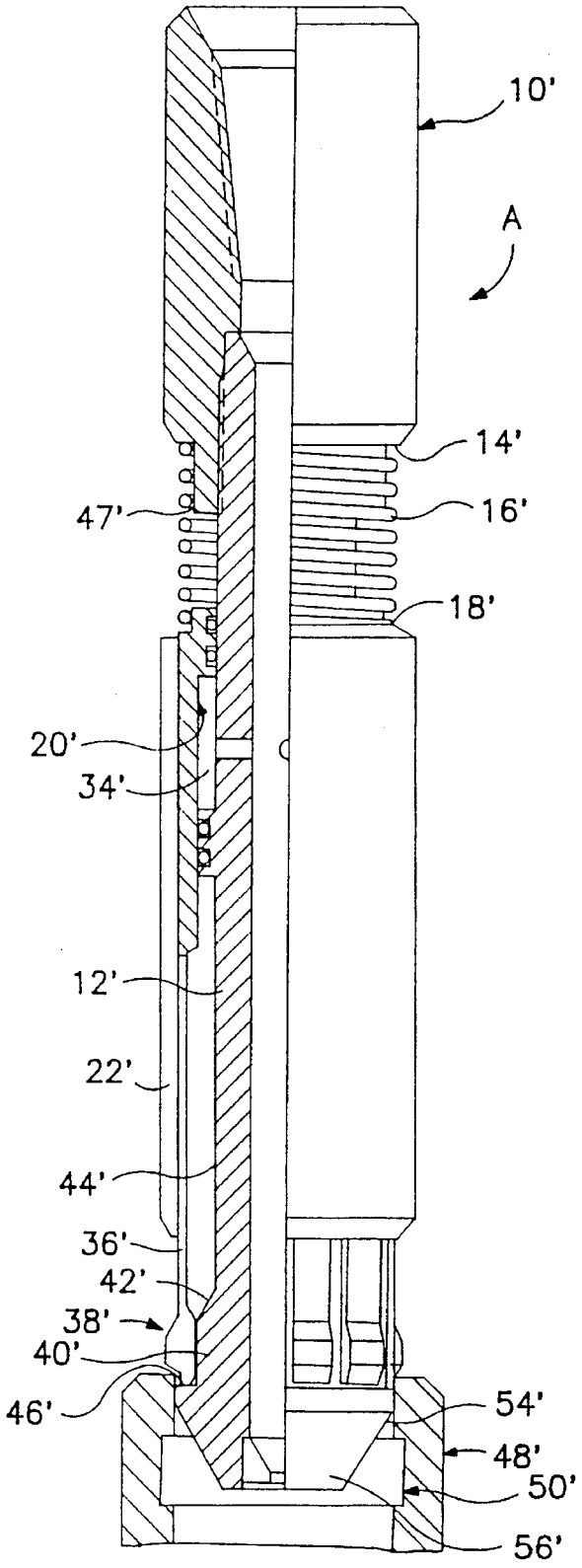
FIG. 13 PRIOR ART
FIG. 13 is a partial cross sectional elevational view of a fishing spear according to the prior art.
Figure 14:
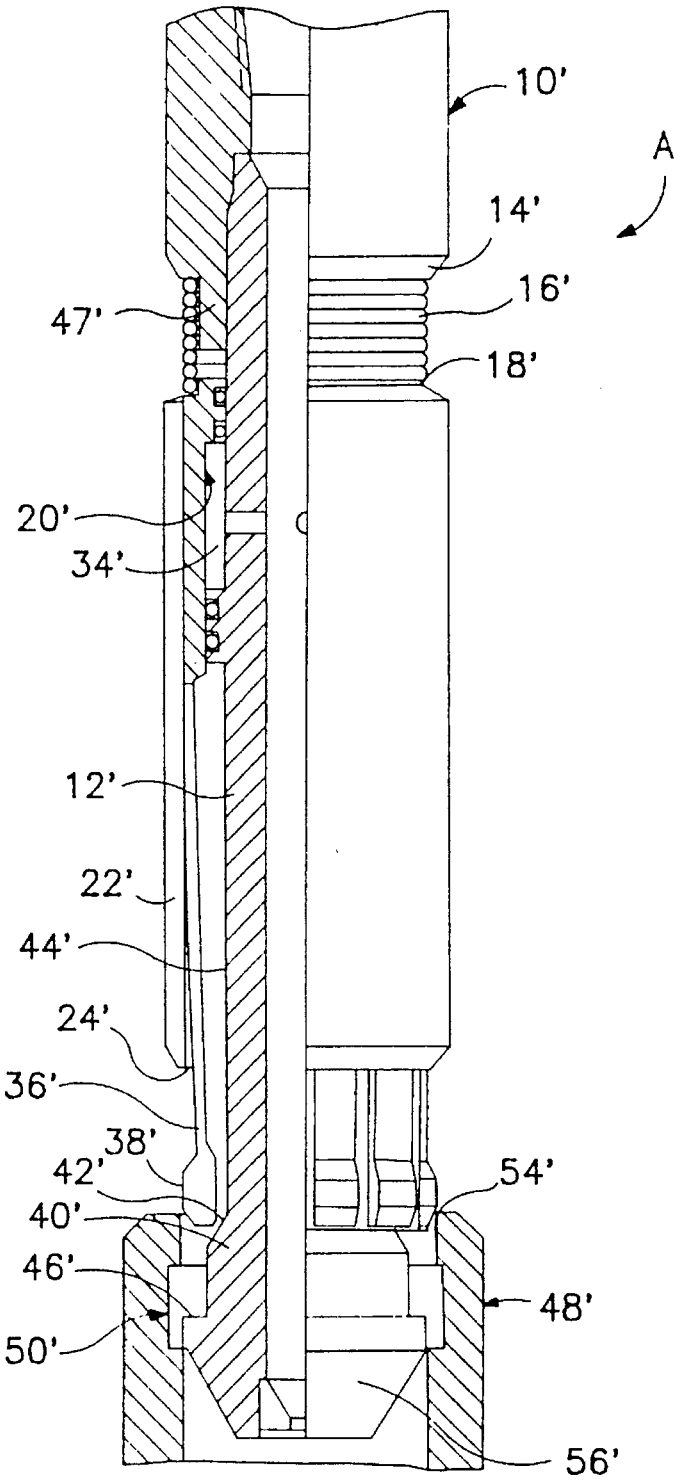
FIG. 14 PRIOR ART
FIG. 14 is a partial cross sectional elevational view of the fishing spear according to the prior art with the collet assembly in the retracted position.
Figure 15:
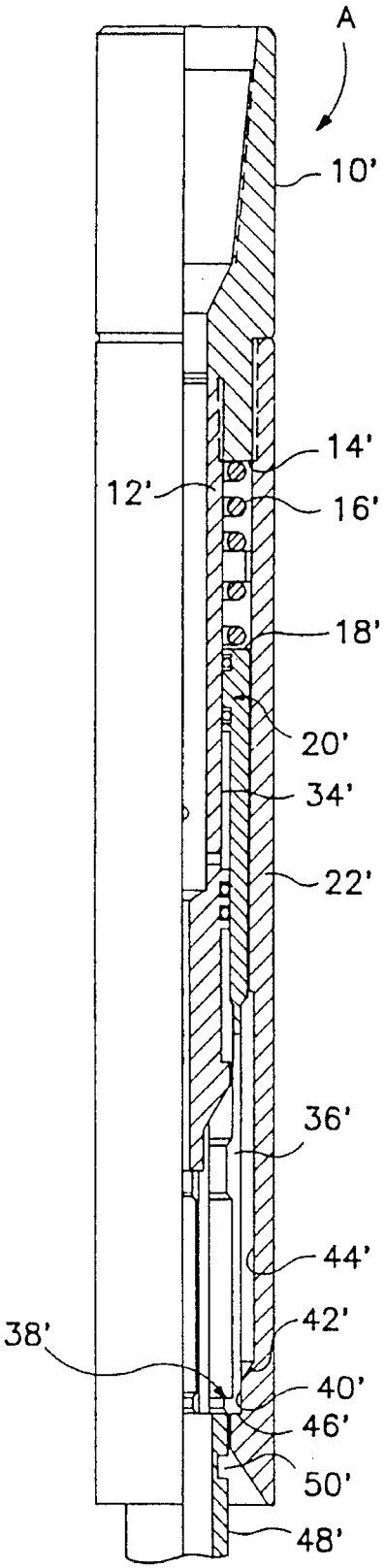
FIG. 15 PRIOR ART
FIGS. 15–18 are partial cross sectional elevational views of an overshot according to the prior art.
Figure 16:
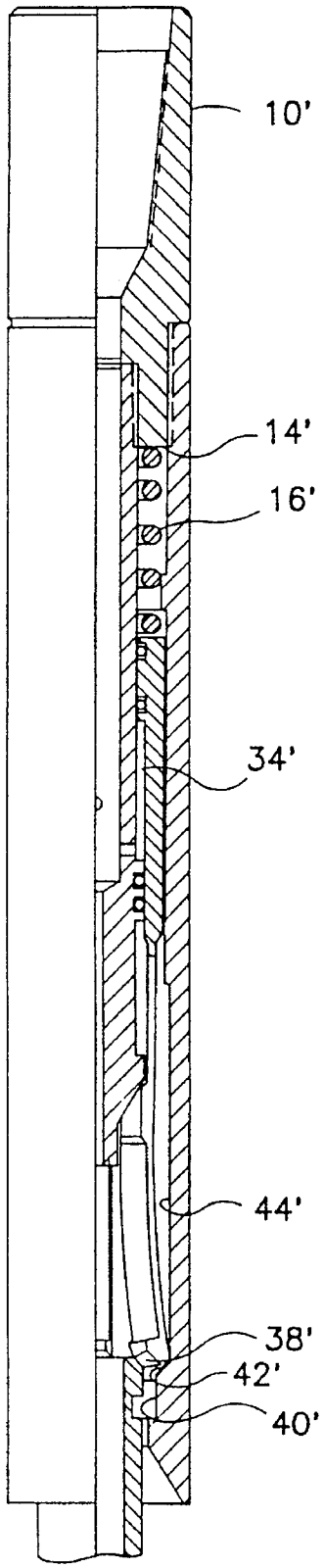
FIG. 16 PRIOR ART
Figure 17:
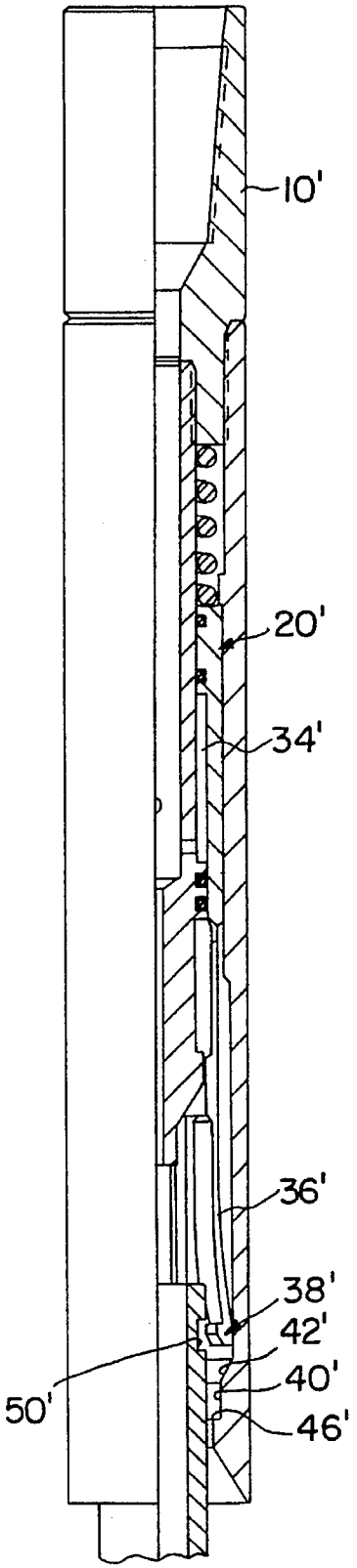
FIG. 17 PRIOR ART
Figure 18:
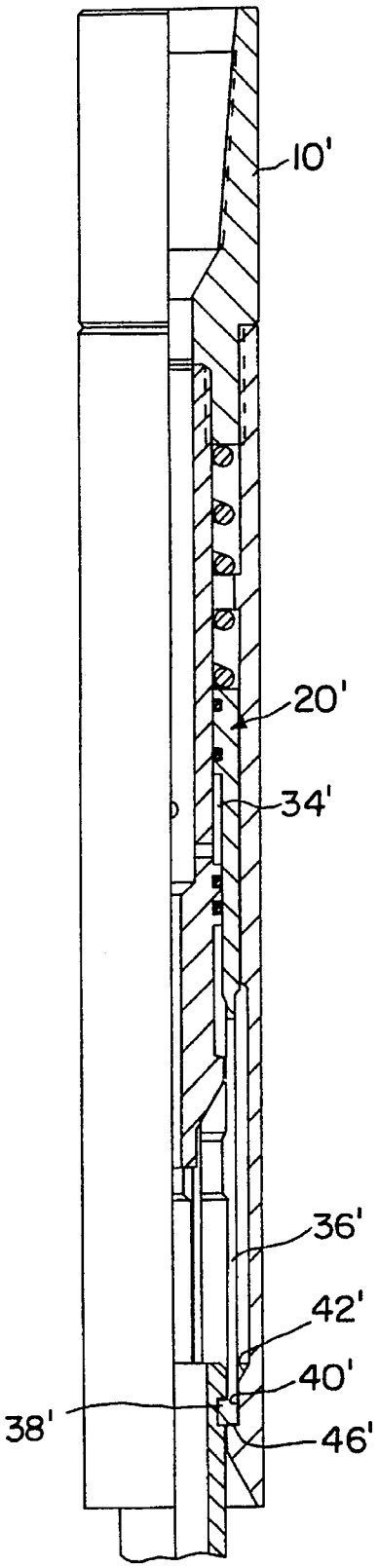
FIG. 18 PRIOR ART

With reference to FIGS. 10–12, portions of the self-cleaning pulling tool according to the second preferred embodiment is shown. In FIG. 10, which is a schematic of the pulling tool as seen from below, collet heads 210 are in their expanded position, as when running down the well casing. Additionally, self-cleaning passages 404 are visible from this angle. FIG. 11 depicts the situation where support sleeve 30 has been raised and collet heads 210 are naturally outwardly radially biased against the inside of cover sleeve 220. FIG. 12 schematically depicts mandrel 12 and self-cleaning passages 404 of the second preferred embodiment.

This invention has been described in connection with the preferred embodiments. These embodiments, however, are merely by way of example and the invention is not restricted thereto. It will be understood by those skilled in the art that other variations and modifications can easily be made within the scope of this invention, as defined by the appended claims.

I claim:

1. An apparatus for retrieving an object from an oil well comprising:

a support body;

gripping means, substantially fixedly positioned against axial movement with respect to said support body, for selectively gripping the object to be retrieved from the oil well;

biasing means, slidably disposed on said support body between said gripping means and said support body, for selectively radially biasing said gripping means for engagement with the object to be retrieved; wherein said support body comprises a mandrel and an outer cover surrounding said mandrel, said biasing means disposed between said gripping means and said outer cover;

an expandable cavity formed between said biasing means and said mandrel;

a bore formed within said mandrel; and a fluid communication path formed between said bore and said expandable cavity.

2. The apparatus of claim 1, said support body further comprises an upper sub having internal and external threads at the top thereof.

3. The apparatus of claim 1, said biasing means comprising a support sleeve having an upper head portion and a lower foot portion interconnected by an intermediate body portion.

4. The apparatus of claim 3, said outer cover having a lower shoulder formed at the bottom thereof.

5. The apparatus of claim 1, said gripping means comprising a collet assembly having a plurality of naturally outwardly radially biased fingers and a collet head at the distal end of each of said fingers, each of said collet heads comprising an inner inclined surface and an outer inclined surface.

6. The apparatus of claim 1, further comprising means for flushing debris accumulating within said support body.

7. An apparatus for retrieving an object from an oil well comprising:

a support body;

gripping means, substantially fixedly positioned against axial movement with respect to said support body, for selectively gripping the object to be retrieved from the oil well;

biasing means, slidably disposed on said support body between said gripping means and said support body, for selectively radially biasing said gripping means for engagement with the object to be retrieved; wherein said support body comprises a mandrel and an outer cover surrounding said mandrel, said biasing means disposed between said gripping means and said outer cover;

said biasing means comprises a support sleeve having an upper head portion and a lower foot portion interconnected by an intermediate body portion;

said outer cover having a lower shoulder formed at the bottom thereof; and further comprising a spring having one end positioned against said upper head portion of said support sleeve and another end positioned against said support body, said spring urging said support sleeve in the direction of said lower shoulder so that said lower foot portion rests on said lower shoulder.

8. The apparatus of claim 7, said support body further comprising an upper sub, said mandrel threadingly received within said upper sub, said apparatus further comprising a stop sleeve positioned around said mandrel and in abutting relationship with said upper sub.

9. The apparatus of claim 8, said spring at least partially positioned between said stop sleeve and said outer cover.

10. An apparatus for retrieving an object from an oil well comprising:

a support body;

gripping means, substantially fixedly positioned against axial movement with respect to said support body, for selectively gripping the object to be retrieved from the oil well; and biasing means, slidably disposed on said support body between said gripping means and said support body, for selectively radially biasing said gripping means for engagement with the object to be retrieved; wherein said support body comprises a mandrel and an outer cover surrounding said mandrel, said biasing means disposed between said gripping means and said outer cover;

said support body further comprises an upper sub having internal and external threads at the top thereof;

said mandrel having external threads formed at the top thereof, said external threads on said mandrel received in said internal threads on said upper sub.

11. An apparatus for retrieving an object from an oil well comprising:

a support body;

gripping means, substantially fixedly positioned against axial movement with respect to said support body, for selectively gripping the object to be retrieved from the oil well; and biasing means, slidably disposed on said support body between said gripping means and said support body, for selectively radially biasing said gripping means for engagement with the object to be retrieved; wherein said support body comprises a mandrel and an outer cover surrounding said mandrel, said biasing means disposed between said gripping means and said outer cover;

said support body further comprises an upper sub, said upper sub having internal and external threads at the bottom thereof;

said outer cover having internal threads formed at the top thereof, said external threads on said upper sub fixedly secured within said internal threads on said outer cover.

12. A method of removing an object from a wellbore with a fishing tool, wherein said fishing tool comprises a support body, gripping means substantially fixedly attached against axial movement with respect to said support body for selectively gripping the object to be retrieved, an outer cover attached to said support body and at least partially surrounding said gripping means, a support sleeve positioned to at least partially surround said gripping means and positioned between said outer cover and said gripping means, said support sleeve having means for selectively radially biasing said gripping means into an active position for engagement with the object to be retrieved, a variable volume cavity formed between said support sleeve and said support body, the method comprising the steps of:

lowering said fishing tool into a wellbore until said fishing tool is subjacent the object to be retrieved;

supplying fluid pressure to said variable volume cavity so that said support sleeve slides along said support body and said gripping means is positioned in the inactive position;

lowering the fishing tool for engagement with the object to be retrieved;

removing the supply of fluid pressure to said variable volume cavity so that said support sleeve slides along said support body and said gripping means is biased to the active position by said biasing means;

raising said fishing tool until said gripping means engages the object to be retrieved; and raising said fishing tool and the object to be retrieved from the wellbore.

* * * * *